US008166947B2

(12) United States Patent
Hashiba et al.

(10) Patent No.: US 8,166,947 B2
(45) Date of Patent: May 1, 2012

(54) RECOIL STARTER

(75) Inventors: Hideki Hashiba, Tokyo (JP); Taro Kihara, Tokyo (JP); Seiichi Nieda, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 282 days.

(21) Appl. No.: 12/644,486

(22) Filed: Dec. 22, 2009

(65) Prior Publication Data

US 2010/0162985 A1 Jul. 1, 2010

(30) Foreign Application Priority Data

Dec. 26, 2008 (JP) ..... P2008-333973

(51) Int. Cl.
*F02N 3/02* (2006.01)

(52) U.S. Cl. ..... 123/185.3

(58) Field of Classification Search ..... 123/185.1, 123/185.14, 185.15, 185.2, 185.3
See application file for complete search history.

(56) References Cited

U.S. PATENT DOCUMENTS

| | | | | |
|---|---|---|---|---|
| 5,431,135 | A * | 7/1995 | Tyler | 123/185.3 |
| 6,718,931 | B2 * | 4/2004 | Morishige et al. | 123/185.3 |
| 6,739,303 | B2 * | 5/2004 | Harada et al. | 123/185.14 |
| 6,959,680 | B2 * | 11/2005 | Hashiba | 123/185.14 |
| 7,032,558 | B2 * | 4/2006 | Nieda et al. | 123/185.3 |
| 7,069,896 | B2 * | 7/2006 | Tsunoda et al. | 123/185.3 |
| 7,201,130 | B2 * | 4/2007 | Hashiba | 123/185.14 |
| 7,213,561 | B2 | 5/2007 | Hashiba | |
| 7,458,355 | B2 * | 12/2008 | Fujita et al. | 123/185.3 |
| 7,810,465 | B2 * | 10/2010 | Sato et al. | 123/185.3 |
| 2009/0139480 | A1 * | 6/2009 | Tohyama | 123/185.3 |

FOREIGN PATENT DOCUMENTS

| | | |
|---|---|---|
| JP | 2001-132591 | 5/2001 |
| JP | 2006-274899 | 10/2006 |

* cited by examiner

*Primary Examiner* — Hai Huynh
(74) *Attorney, Agent, or Firm* — Nixon & Vanderhye P.C.

(57) ABSTRACT

According to an aspect of the present invention, there is provided a recoil starter including: a case having a reel supporting shaft; a rope reel having: a tubular shaft portion; an engaging portion; a rope housing groove to house a recoil rope; and a spring housing portion to house a spiral spring; a ratchet axially-slidably arranged outside the tubular shaft portion; a ratchet guide attached to an end of the reel supporting shaft; and a return spring provided between the ratchet guide and the ratchet, wherein an inclined surface and a locking surface are formed on the engaging portion to be engageable with the ratchet, and wherein the inclined surface guides the ratchet toward to be engaged with the driving pulley, thereby rotating the driving pulley and starting the engine, when the rope reel is rotated.

6 Claims, 8 Drawing Sheets

RECOIL STARTER

CROSS-REFERENCE TO RELATED APPLICATIONS

This application claims priority from Japanese Patent Application No. 2008-333973 filed on Dec. 26, 2008, the entire contents of which are herein incorporated by reference.

BACKGROUND OF THE INVENTION

1. Field of the Invention

An aspect of the present invention relates to a recoil starter in which a rope reel is rotated when a recoil rope is pulled and transmits the rotation to a driving pulley connected to an engine crankshaft, thereby starting the engine.

2. Background Art

There is known a recoil starter (for example, refer to JP-2001-132591-A) in which a rope reel is rotated when a recoil rope wound therearound is pulled, a cam is rotated by the rotation of the rope reel, the rotation of the cam is transmitted to a rotational member (e.g., flywheel magnet or driving pulley) coupled with a crankshaft of an engine via a clutch mechanism (e.g., centrifugal clutch), and the crankshaft is rotated via the rotational member to start the engine. In this recoil starter, a shock-absorb power-accumulation member is interposed between the rope reel and the cam so that a shock caused by an abrupt fluctuation in load on the engine is not transmitted to the rope reel, and the rotation force from the rope reel is stored in the shock-absorb power-accumulation member so that the stored rotation force is released to easily start the engine.

In the above conventional mechanism, the rope reel to be rotated by pulling the recoil rope, the cam to transmit the rotation force to a starting pulley that is coupled with the engine crankshaft via the clutch mechanism and the spring case to house a spring as the shock-absorb power-accumulation member are rotatably supported by a supporting shaft formed within the case, and a one-way clutch mechanism is formed between the rope reel and the spring case to transmit the rotation of the rope reel in the engine starting direction to the spring case. When the recoil rope is pulled to rotate the rope reel, the spring case is integrally rotated via the one-way clutch mechanism to transmit the rotation of the rope reel to the starting pulley via the spring case. And, when the rotation of the starting pulley is stopped by the starting resistance of the engine, the rotation force of the rope reel is stored in the spring. The one-way clutch is formed between the supporting shaft and the spring case to prevent the reverse rotation of the spring case.

In the conventional recoil starter, the starter case is fixed to an engine-side housing with bolts. Further, since individual parts are formed to be assembled together with screws one by one, assembly man-hours increase, and a certain amount of time is required to complete the recoil starter.

SUMMARY OF THE INVENTION

Exemplary object of the present invention is to provide a recoil starter capable of reducing the time required for assembly and improving operation efficiency.

According to a first aspect of the present invention, there is provided a recoil starter including: a starter case that is positioned to face an engine-side driving pulley and that has a reel supporting shaft at a center thereof; a rope reel having: a tubular shaft portion formed at a center of the rope reel to be rotatably engaged to the reel supporting shaft; an engaging portion protruding from the rope reel to be substantially parallel to the tubular shaft portion; a rope housing groove formed at an outer-peripheral side of the rope reel to house a recoil rope; and a spring housing portion formed at an inner-peripheral side of the rope reel to house a spiral spring for rewinding the rope reel; a ratchet having: a ratchet body axially-slidably arranged outside the tubular shaft portion; and a ratchet arm outwardly protruding from the ratchet body; a ratchet guide attached to an end of the reel supporting shaft to provide a frictional resistance to a rotation of the ratchet; and a return spring provided between the ratchet guide and the ratchet to urge the ratchet toward a proximal end of the tubular shaft portion, wherein an inclined surface and a locking surface are formed on the engaging portion so as to be engageable with the ratchet arm, and wherein the inclined surface of the engaging portion is formed to guide the ratchet arm so that the ratchet is moved toward a distal end of the tubular shaft portion against the return spring and so that the ratchet arm engages with the driving pulley, thereby rotating the driving pulley and starting the engine, when the rope reel is rotated.

According to a second aspect of the present invention, there is provided the recoil starter, wherein the ratchet is formed such that a front side and a rear side thereof are symmetrical.

According to a third aspect of the present invention, there is provided the recoil starter, wherein an annular groove is formed on an outer periphery of a distal end of the reel supporting shaft, and wherein a potbelly-shaped set spring is locked and mounted to the annular groove so as to prevent the ratchet guide from coming-off therefrom and to provide a friction to a rotation of the ratchet guide with respect to the reel supporting shaft.

According to a fourth aspect of the present invention, there is provided the recoil starter, wherein the ratchet guide includes a plurality of locking pieces protruding therefrom to follow an outer shape of the tubular shaft portion, wherein the return spring and the ratchet are arranged outside the locking pieces, and wherein tips of the locking pieces are locked to the ratchet.

According to a fifth aspect of the present invention, there is provided a recoil starter including: a starter case disposed to face an engine-side driving pulley; a reel supporting shaft formed at a center of the starter case; and a rope reel rotatably provided on the reel supporting shaft to transmit a rotation to the engine-side driving pulley and to start an engine when a recoil rope on the rope reel is pulled, wherein the rope reel includes: a rope housing groove formed at an outer-peripheral side of rope reel to house the recoil rope; and a rope-end housing portion formed at an inner-peripheral side of the rope reel with respect to the rope housing groove, wherein a cutout is formed in a portion of a groove wall defining the rope housing groove to communicate the rope housing groove and the rope-end housing portion, and wherein a U-shaped guide groove is formed in the starter case to guide a pulling-out of the recoil rope.

According to a sixth aspect of the present invention, there is provided a recoil starter including: a rope reel rotatably provided on a reel supporting shaft to transmit a rotation to an engine-side driving pulley and to start an engine when a recoil rope on the rope reel is pulled, wherein the reel supporting shaft is formed in a tubular shape, and wherein a portion of a crankshaft or a nut on the crank shaft of the engine is inserted inside the reel supporting shaft.

According to a seventh aspect of the present invention, there is provided a recoil starter including: a starter case attached to an engine-side housing; a reel supporting shaft formed at a center of the starter case; and a rope reel rotatably provided on the reel supporting shaft to transmit a rotation to an engine-side driving pulley and to start an engine when a recoil rope on the rope reel is pulled, wherein a pair of protrusion and recess are formed on facing surfaces of the starter case and the engine-side housing at corresponding positions, the pair of protrusion and recess positioning the starter case with respect to the engine-side housing, and wherein a pair of locking portions are formed on the starter case and on the engine-side housing at corresponding positions, the pair of locking portions engaging the starter case with respect to the engine-side housing by a snap fit.

According to the first aspect of the present invention, a reel subassembly is completed by accommodating the recoil spring and the spiral spring in the housing portions, respectively. Similarly, a ratchet subassembly is completed by mounting the return spring outside the locking pieces of the ratchet guide, fitting the ratchet thereonto while compressing the return spring to lock the tip locking juts of the locking pieces to the engaging edge of the ratchet by snap fit. When assembling the above subassemblies into the starter case, first, the tubular shaft portion of the reel subassembly is fitted and mounted to the reel supporting shaft of the starter case. Next, the ratchet subassembly is fitted and mounted to the tubular shaft portion. Finally, the ratchet subassembly is retained at the end of the reel supporting shaft. Since the recoil starter is completed on the engine by only these steps, assembly becomes easy, and assembly time can be reduced to improve operation efficiency.

According to the second aspect of the present invention, assembly operation is simplified by omitting the confirmation work of the front and rear sides during the assembly of the ratchet.

According to the third aspect of the present invention, the ratchet guide can be assembled only by locking and mounting the set spring onto the annular groove of the reel supporting shaft. By using the set spring, the operation of attaching the ratchet guide to the reel supporting shaft is remarkably simplified as compared with operations, such as screwing. And, since the set spring also provides the frictional resistance against the rotation of the ratchet guide, assembly man-hours can be reduced without providing a dedicated friction imparting member.

According to the fourth aspect of the present invention, the ratchet, the ratchet guide, and the return spring can be integrally assembled in advance as a subassembly. When being assembled into the starter case, the subassembly may be simply fitted to the tubular shaft portion of the rope reel. Thus, assembly man-hours can be reduced.

According to the fifth aspect of the present invention, a knot-formed end portion of the recoil rope is housed into the rope-end housing portion, an intermediate portion of the recoil rope continuous therefrom is drawn from the cutout of the groove wall to be wound around the rope housing groove, and a pulling-out portion of the recoil rope is inserted into the U-shaped guide groove through an opened portion thereof. Since an operation of passing the recoil rope through a hole is unnecessary, assembling of the rope can be simplified.

According to the sixth aspect of the present invention, although the starter case receives a strong force and is deformed when the recoil rope is strongly pulled to rotate the rope reel, since the reel supporting shaft is supported by the crankshaft, the deformation is suppressed. Accordingly, the rope reel can be smoothly rotated, and the engine can be stably started.

According to the seventh aspect of the present invention, assembly operation of the starter case becomes easy, and positioning and fixing can be realized by simple structure.

DETAILED DESCRIPTION OF EMBODIMENTS

Figure 1:
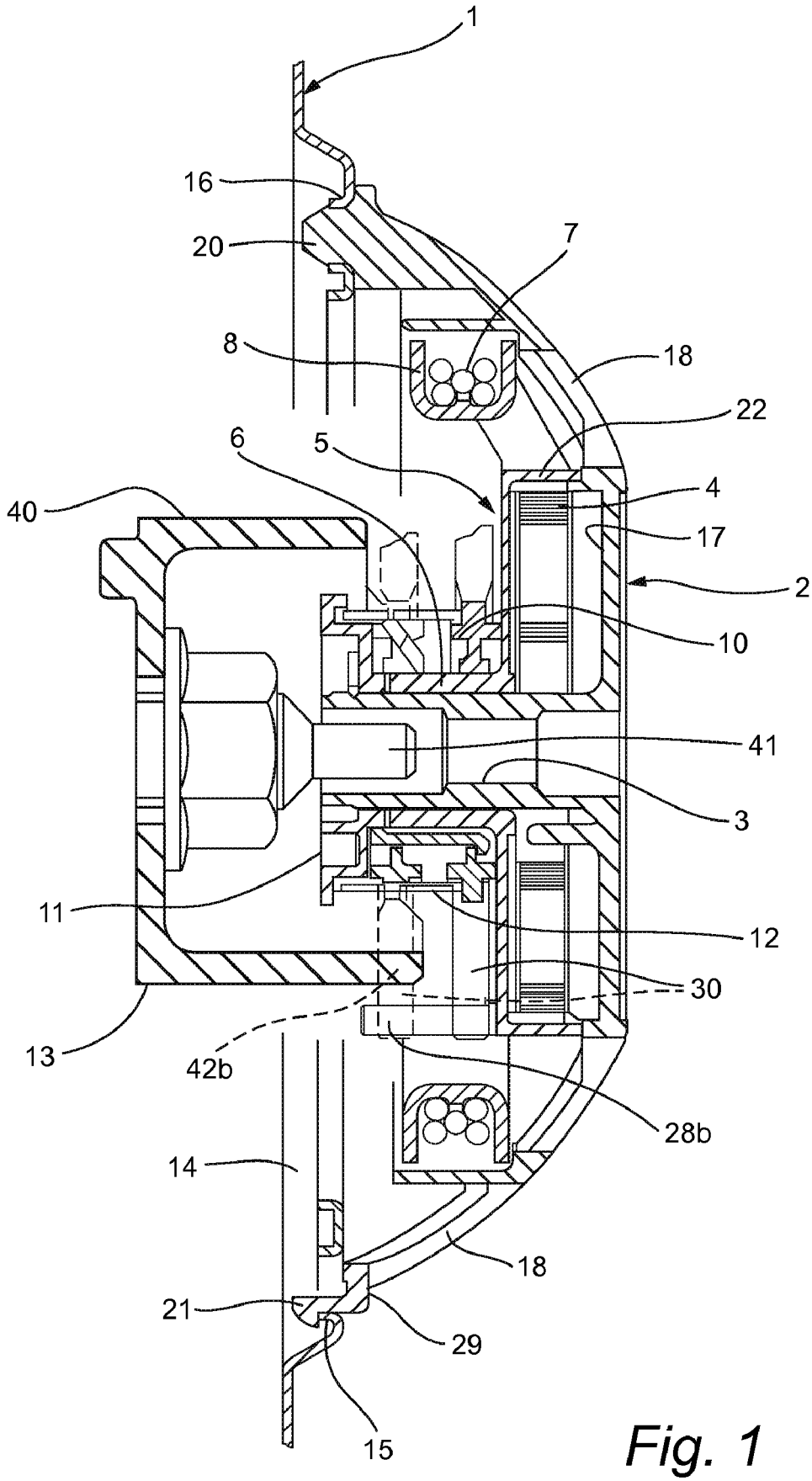
FIG. 1 is a longitudinal side sectional view of a recoil starter of an exemplary embodiment.
Figure 2:
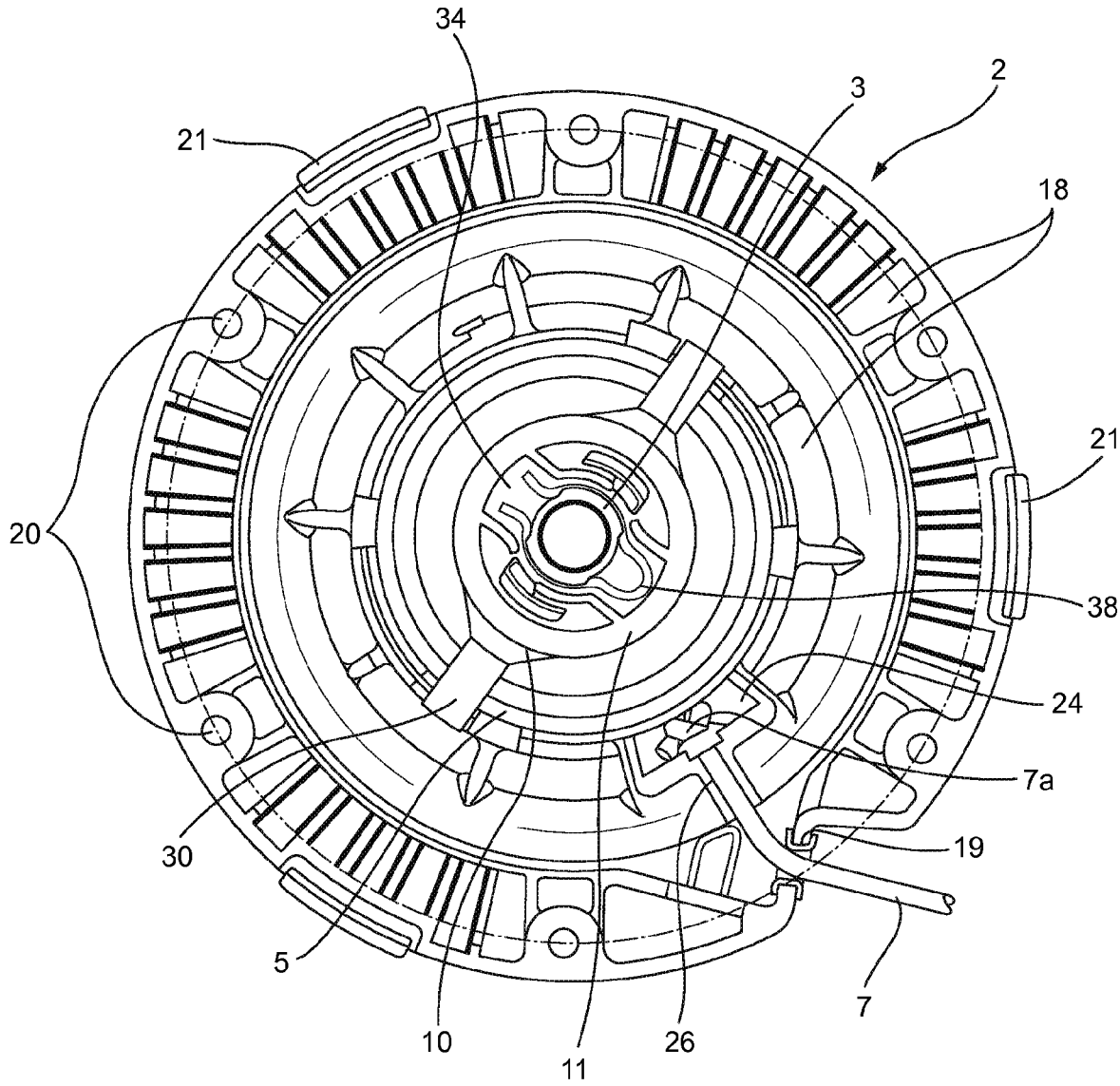
FIG. 2 is a rear view of the recoil starter.

An exemplary embodiment will be described below with reference to FIGS. 1 to 6B. A recoil starter of the embodiment is configured of a starter case 2 fixed to an engine-side housing 1 and having a reel supporting shaft 3 at the center, a spiral spring 4 arranged to face the bottom of the starter case 2, a rope reel 5 having a tubular shaft portion 6 to be rotatably fitted onto the reel supporting shaft 3 at the center and a rope housing groove 8 for a recoil rope 7 on the outer peripheral side, a ratchet 10 arranged outside the tubular shaft portion 6 so as to be slidable in a sliding direction (axial direction), a ratchet guide 11 attached to an end of the reel supporting shaft 3 to prevent the ratchet 10 from coming-off, and a return spring 12 provided between the ratchet guide 11 and the ratchet 10.

A circular opening 14 is formed in the engine-side housing 1 to receive a driving pulley 13, and hook-shaped locking portions 15 and positioning recesses 16 are respectively formed on the peripheral edge of the opening 14 at regular intervals.

Figure 3:
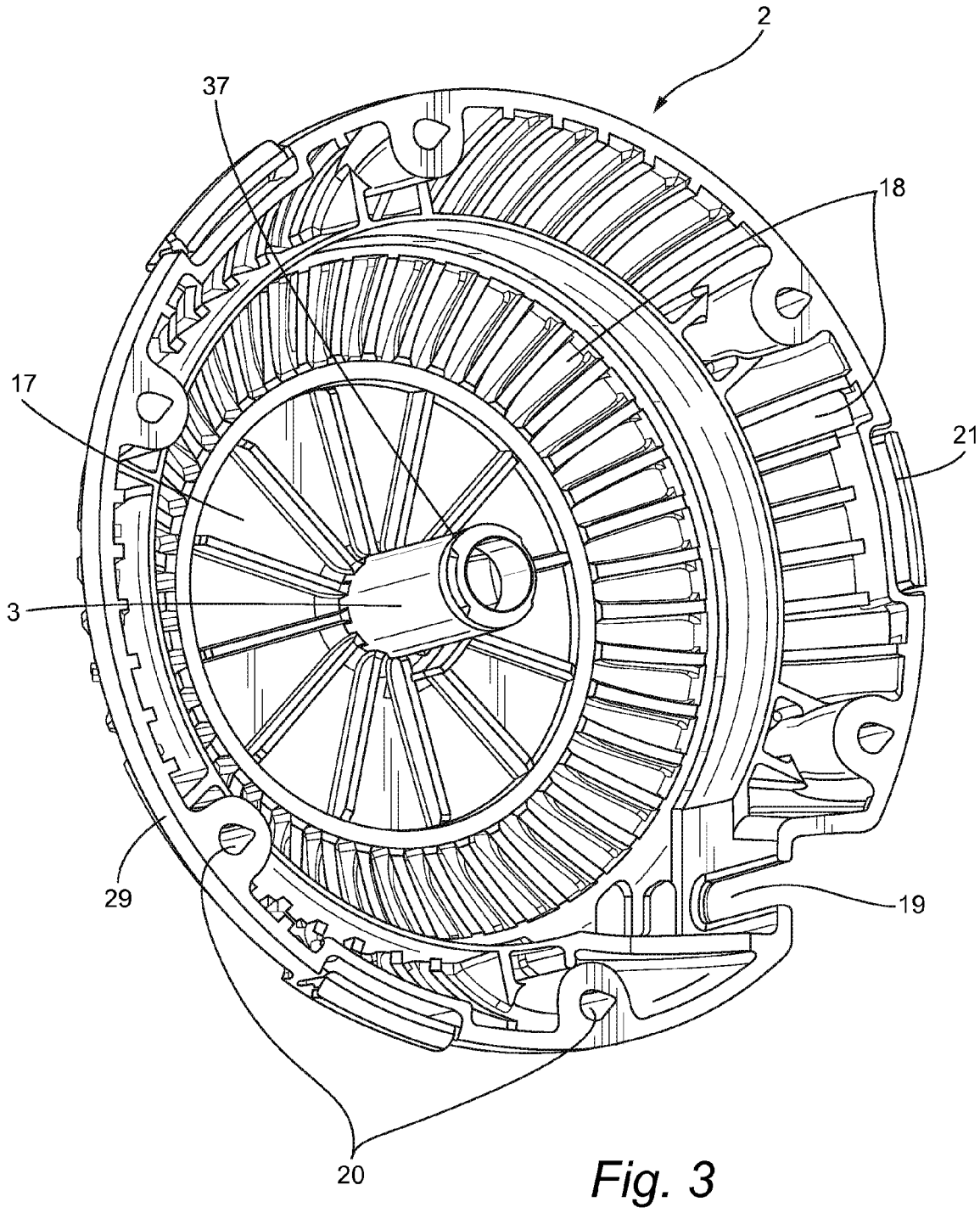
FIG. 3 is a perspective view of a starter case.

The starter case 2 is formed into a pan like shape as shown in FIG. 3, and is arranged to face the driving pulley 13 coupled with the engine. The tubular reel supporting shaft 3 is formed on the center of a circular bottom portion 17, and ventilation holes 18 are formed on the peripheral edge of the bottom portion 17. Positioning protrusions 20 and locking portions 21 are respectively formed on the outermost peripheral edge of the starter case 2 at equal intervals. Moreover, a U-shaped guide groove 19 (refer to FIG. 3) which guides pull-out of the recoil rope 7 is opened and formed on an outer peripheral edge 29.

The positioning protrusions 20 are engaged with the positioning recesses 16 for positioning, and the locking portions 21 are locked to the hook-shaped locking portions 15 by snap fit, thereby elastically locking and fixing the starter case 2 to the housing 1.

The positioning recesses 16 and the positioning protrusions 20 are not limited to the illustrated forms. Recesses may be formed on the housing 1, and protrusions may be formed in the starter case 2. Additionally, the housing 1 may be made of not only metal but also synthetic resin.

Figure 4:
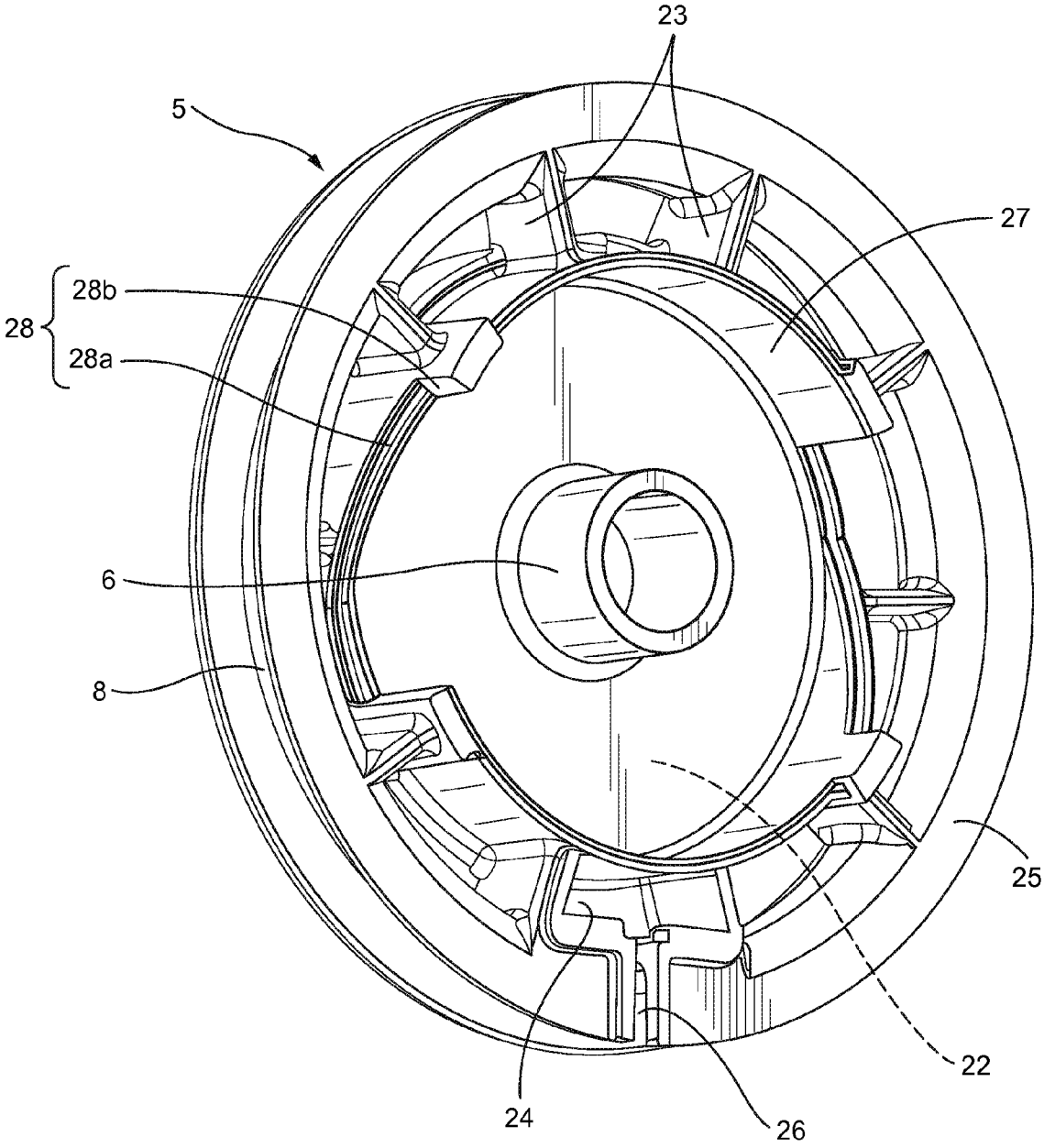
FIG. 4 is a perspective view of a rope reel.

As shown in FIG. 4, in the rope reel 5, the tubular shaft portion 6 is formed on the center, a spiral spring housing portion 22 is formed on the radial-outer side of the tubular shaft portion 6, and the rope housing groove 8 is formed on the radial-outer side of the spiral spring housing portion 22 via radially protruding supporting pieces 23. The spiral spring 4 for rotating the rope reel 5 in an unwinding direction is accommodated in the spiral spring housing portion 22. One end of the spiral spring 4 is fixed to the starter case 2, and the other end thereof is fixed to the rope reel 5. The rope housing groove 8 is formed into a U-sectional-shape opened outwardly.

A rope-end housing portion 24 is formed between two of the supporting pieces 23 that are positioned radial-inside of the rope housing groove 8, and a cutout 26 is formed on a groove wall 25 of the rope housing groove 8 at a side where the reel supporting shaft 3 is formed. The cutout 26 and the rope-end housing portion 24 are opened at the same side, and are formed to be continuous with each other.

At a side of the rope reel 5 opposite to the spiral spring housing portion 22, an annular wall 27 is protrudingly formed to be substantially parallel to the shaft portion 6, and engaging portions 28 are formed by cutting out portions of the annular wall 27. Each engaging portion 28 is configured of an inclined surface 28*a* and a locking surface 28*b* continuous therewith, and the locking surface 28*b* is formed parallel to the axial direction of the tubular shaft portion 6.

Figure 5:
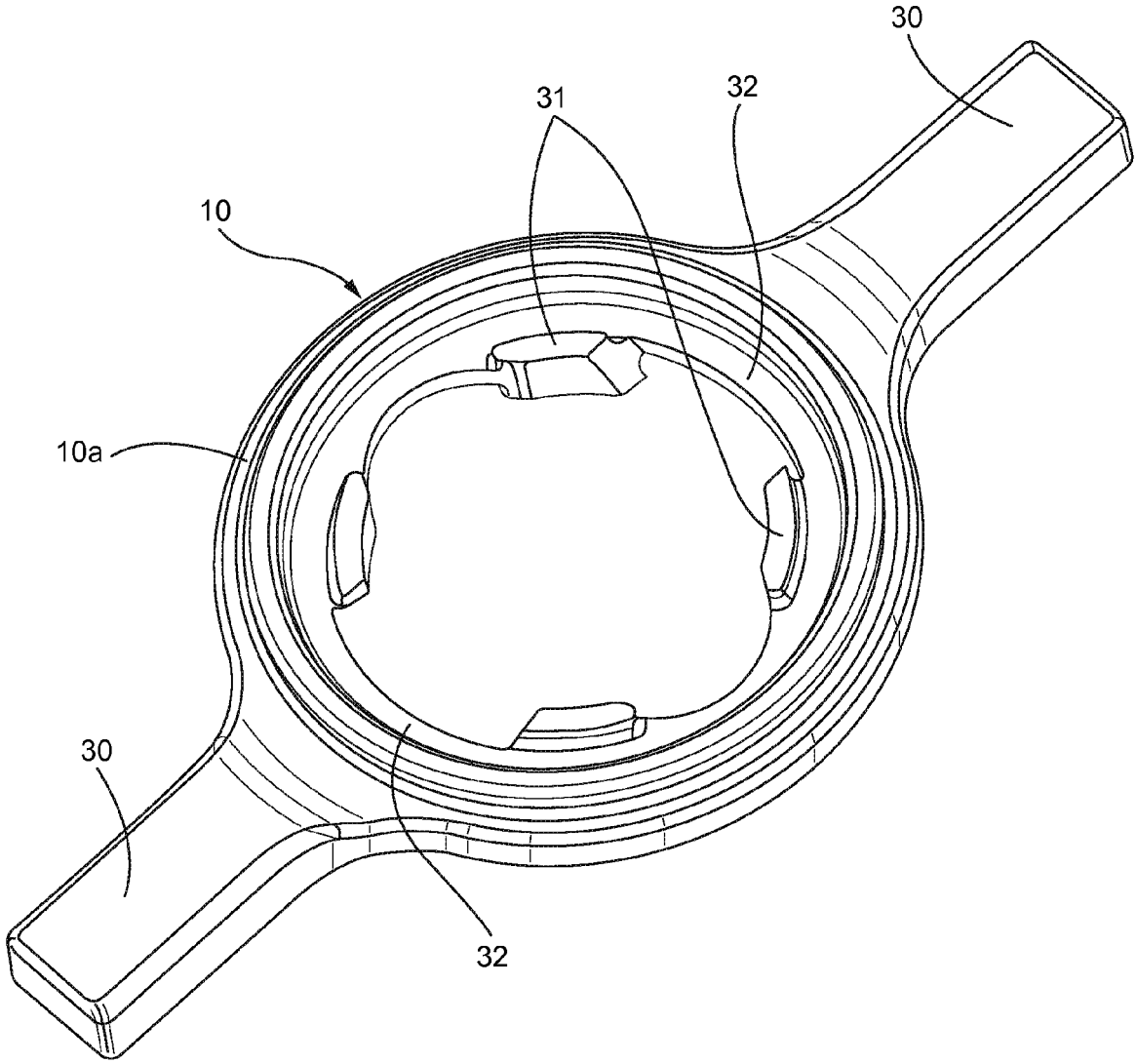
FIG. 5 is a perspective view of a ratchet.

As shown in FIG. 5, the ratchet 10 has an annular ratchet body 10*a* and ratchet arms 30 protruding in mutually opposite directions therefrom. Four engaging portions 31 protrude on the inner peripheral side of the annular ratchet body 10*a*, and an engaging edge 32 is formed between two engaging portions 31 facing with each other.

The ratchet 10 is formed such that the front and rear sides thereof are symmetrical. As a result, the confirmation of the front and rear sides is not required during the assembly of the ratchet 10, thereby facilitating the assembly.

Figure 6A:
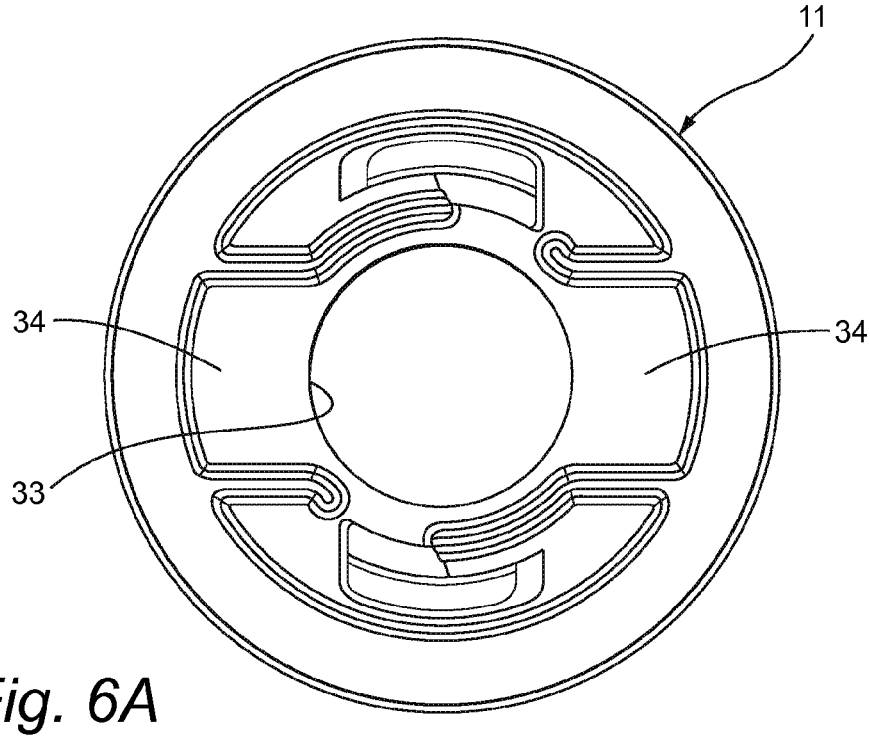
FIGS. 6A and 6B are perspective views of a ratchet guide.
Figure 6B:
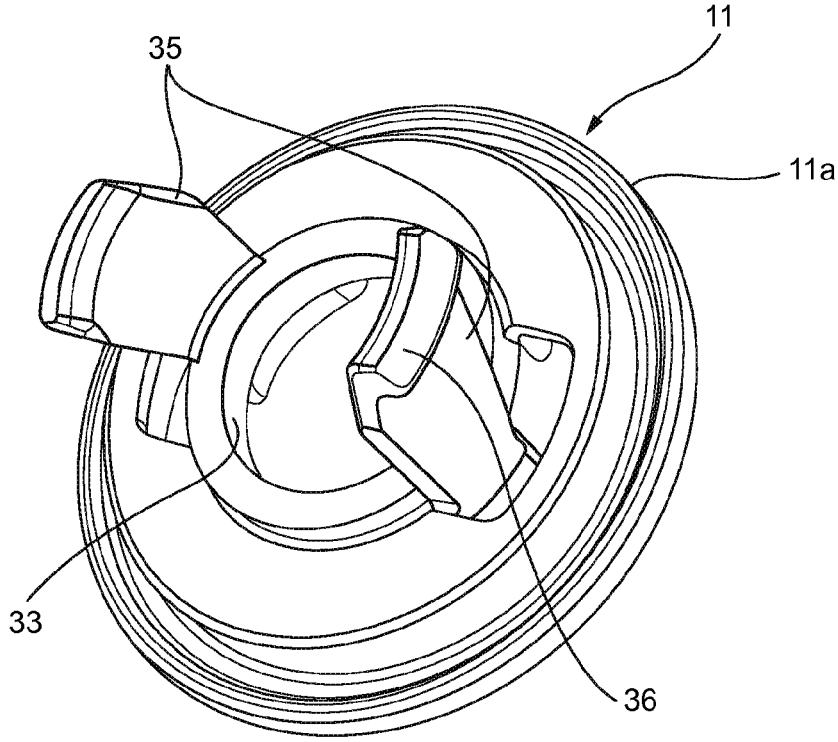

As shown in FIGS. 6A and 6B, the ratchet guide 11 is formed to guide the sliding of the ratchet 10 and to prevent the coming off of the ratchet 10. The ratchet guide 11 has a disk-like ratchet guide body 11*a* having a fitting hole 33 at the center. The fitting hole 33 is engageable with the reel supporting shaft 3. Spring receiving recesses 34 are formed on one surface of the ratchet guide body 11*a*, and a pair of locking pieces 35 are protrudingly formed on the other surface of the ratchet guide body 11*a*. A locking jut 36 is formed at the tip of each locking piece 35. The locking piece 35 has a narrow base and a wide tip. A tubular shaft portion 6 of the rope reel 5 is fitted between the two locking pieces 35.

The ratchet guide 11 is rotatably arranged outside the tubular shaft portion 6, and is held by a potbelly-shaped set spring 38 (refer to FIG. 2) locked and mounted to an annular groove 37 (refer to FIG. 3) formed at the outer periphery of an end of the reel supporting shaft 3. The set spring 38 is housed in the spring receiving recesses 34 of the ratchet guide 11. The set spring 38 always rotates together with the ratchet guide 11 to provide a friction, thereby causing a sliding resistance during the rotation of the ratchet guide 11.

The ratchet 10 is mounted so as to be slidable along the locking pieces 35 of the ratchet guide 11. That is, the locking juts 36 of the tips of the locking pieces 35 are elastically locked to the engaging edge 32 by snap fit, the locking pieces 35 are sandwiched between the engaging portions 31 adjoining to the engaging edge 32, and the ratchet 10 rotates along with the ratchet guide 11 and slides along the axial direction of the reel supporting shaft 3 while being guided by the locking pieces 35.

The return spring 12 of a coil spring is arranged between the ratchet guide body 11*a* and the ratchet 10. For this reason, the ratchet 10 is biased to be positioned at the base side of the tubular shaft portion 6.

Figure 7:
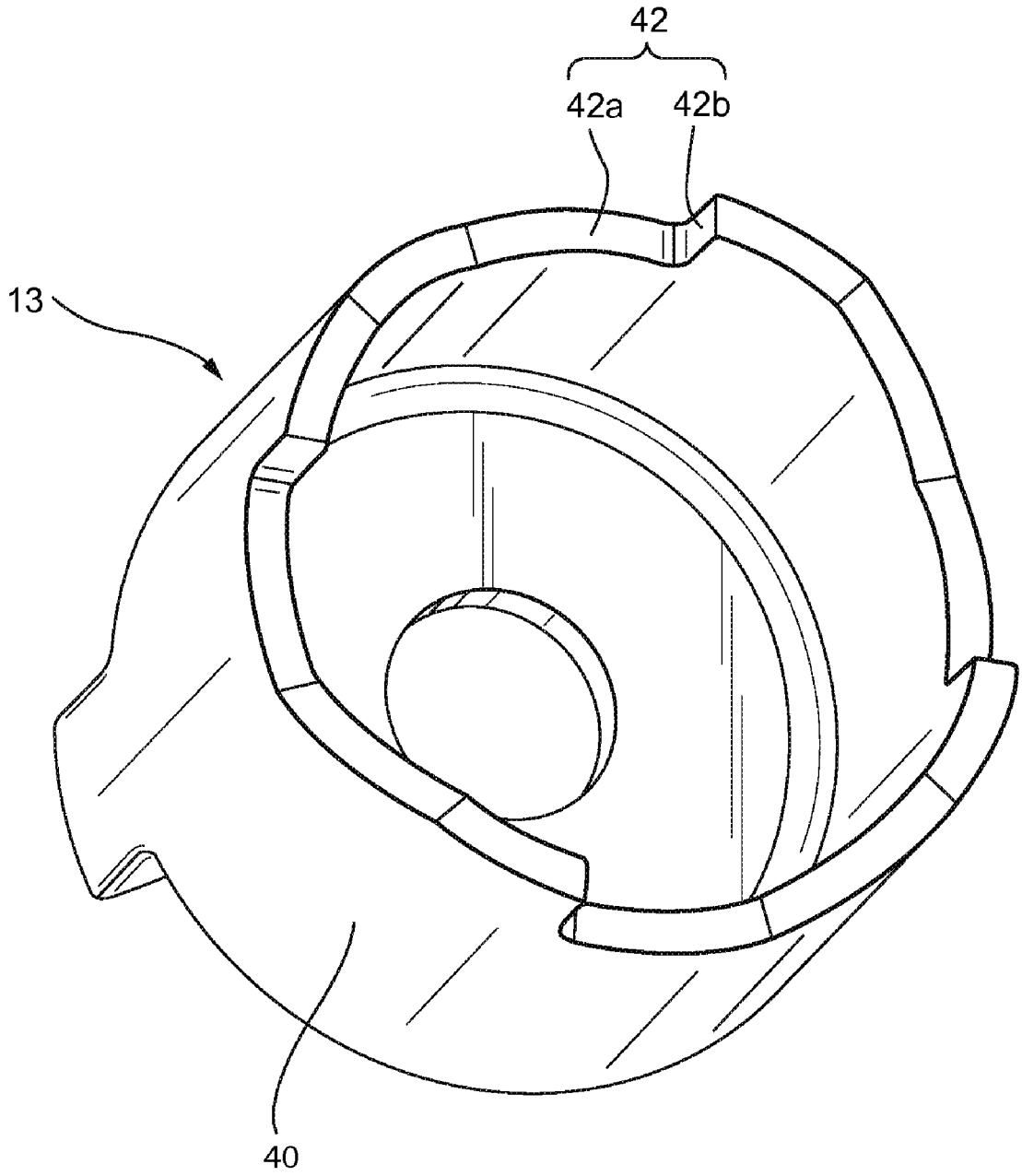
FIG. 7 is a perspective view of a driving pulley.

As shown in FIG. 7, the driving pulley 13 is fixed to a crankshaft 41 of an engine, an annular wall 40 is formed so as to surround the periphery of the crankshaft 41, and engaging portions 42 are formed on an end of the annular wall 40. Each engaging portion 42 is configured of an inclined surface 42*a* and a locking surface 42*b* continuous therewith. The locking surface 42*b* is formed parallel to the axial direction of the crankshaft 41. The inclined surface 42*a* is formed to have an opposite inclination with respect to the inclined surface 28*a* of the rope reel 5 as seen from the radial direction.

The annular wall 40 of the driving pulley 13 is formed to be positioned inside the annular wall 27 of the rope reel 5.

As shown in FIG. 1, a portion of the crankshaft 41 (or a nut on the crankshaft) is inserted into an internal space of the reel supporting shaft 3 of the starter case 2. As a result, the starter case 2 is fixed by the positioning recesses and protrusions 16 and 20 and the locking portions 15 and 21 at its outer peripheral edge 29, while being supported by the crankshaft 41 of the engine at its reel supporting shaft 3.

Figure 8A:
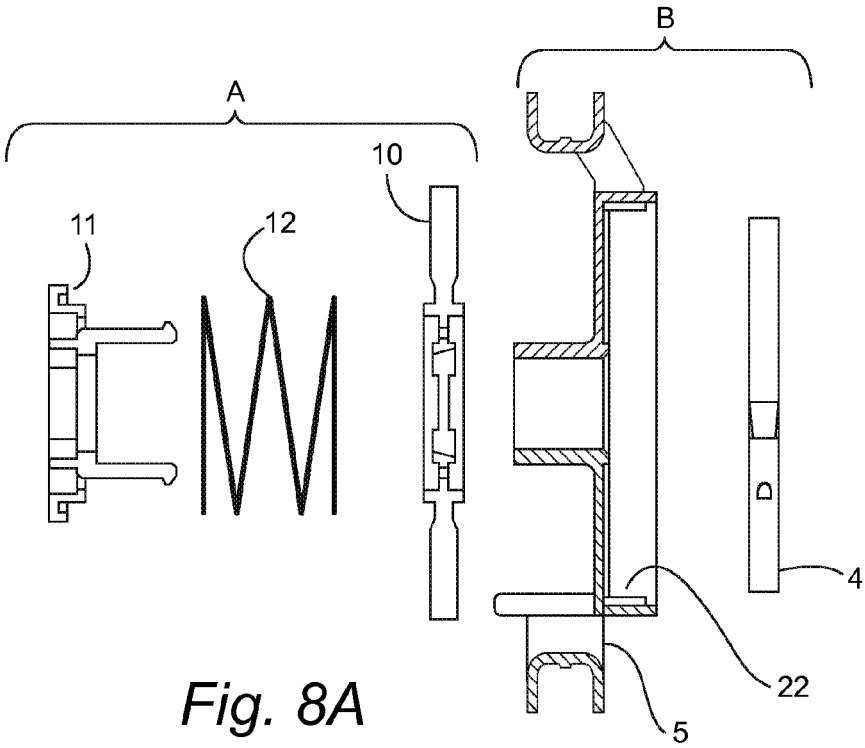
FIGS. 8A and 8B are views for explaining a method of assembling the recoil starter.
Figure 8B:
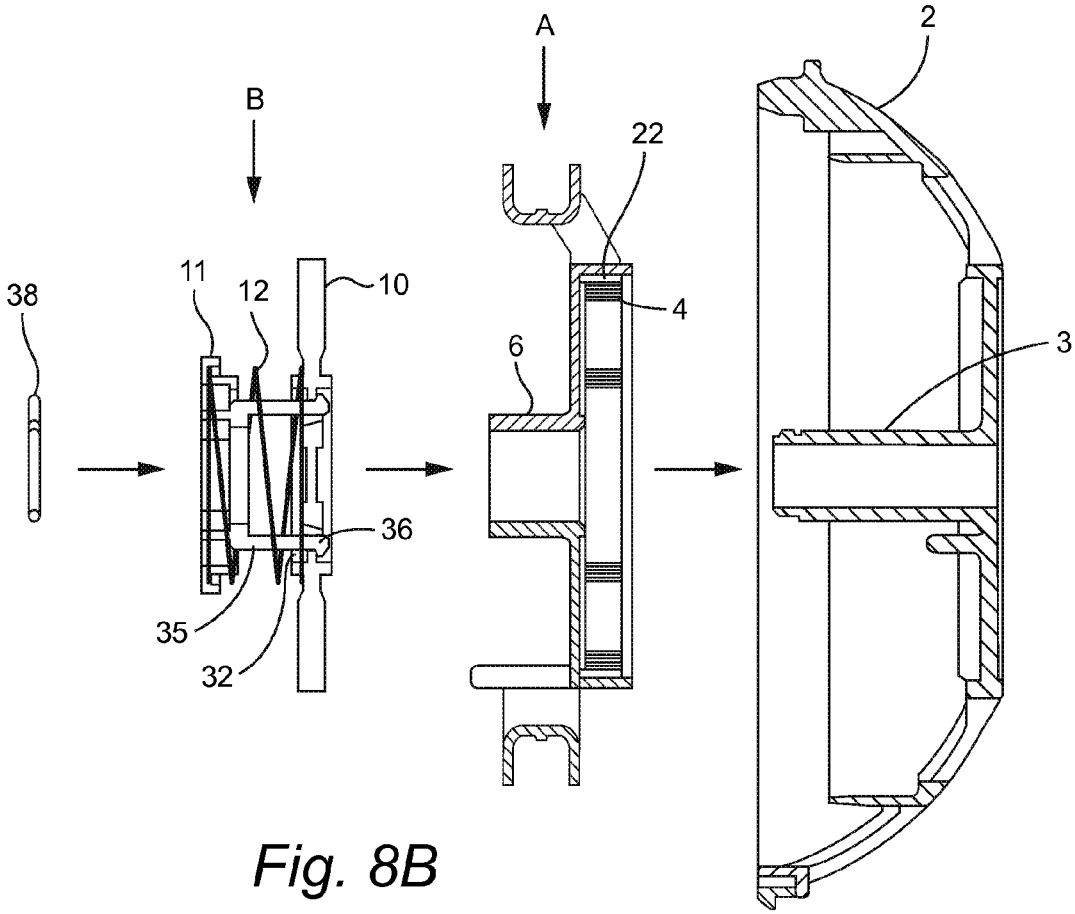

When the recoil starter is assembled by the above respective components, first, several parts are made into a subassembly as in FIGS. 8A and 8B.

That is, the recoil rope 7 is wound around the rope reel 5, the spiral spring 4 is accommodated in the spiral spring housing portion 22, and one end of the spiral spring is locked to the rope reel 5, thereby completing a reel subassembly A. As described above, the end of the recoil rope 7 is housed in the rope-end housing portion 24 so that a knot 7*a* is made in advance and pushed into the cutout 26 and the rope-end housing portion 24 as in FIG. 2, thereby omitting the operation of passing the recoil rope through a hole. As a result, the housing operation can be easily and rapidly performed.

Similarly, the return spring 12 is mounted outside the locking pieces 35 of the ratchet guide 11, the ratchet 10 is fitted, and the locking juts 36 of the tips of the locking pieces 35 are locked to the engaging edge 32 of the ratchet 10 by snap fit while bending the return spring 12, thereby completing a ratchet subassembly B.

When the above-described subassemblies A and B are assembled into the starter case 2, first, the tubular shaft portion 6 of the subassembly A is fitted and mounted to the reel supporting shaft 3 of the starter case 2. Next, the ratchet subassembly B is fitted and mounted outside the tubular shaft portion 6. Then, the set spring 38 is locked and mounted to the end of the reel supporting shaft 3. By only these steps, the recoil starter for the engine is completed. In addition, the recoil rope 7 is pulled out to the outside from the guide groove 19 (refer to FIG. 3) of the starter case 2.

When the recoil starter is mounted onto the engine-side housing 1, as shown in FIG. 1, the positioning recesses 16 of the outer peripheral edge 29 of the starter case 2 are fitted to the positioning protrusions 20 of the housing 1, and the locking portions 21 of the starter case 2 are locked to the locking portions 15 of the housing 1 by snap fit, thereby fixing the starter case 2 into position.

As described above, the recoil starter is assembled by previously assembling several parts in to the subassemblies A and B and sequentially assembling these assemblies A and B into the starter case 2. Since screws are not used, operation efficiency is excellent, and assembly can be easily and rapidly made in a short time.

Since the starter case 2 including the reel supporting shaft 3 is mounted by snap fit, assembly operation becomes easy. And, a portion of the crankshaft 41 (or a nut on the crankshaft) of the engine is inserted into the internal space of the reel supporting shaft 3. When the recoil rope 7 is strongly pulled to rotate the rope reel 5, the starter case 2 receives a strong force toward the pull-out side and is deformed. However, since the reel supporting shaft 3 is supported by the crankshaft 41, deformation is suppressed. As a result, the rope reel 5 can be smoothly rotated, and the engine can be stably started.

In the ratchet subassembly B, since the ratchet 10 and the return spring 12 are arranged outside the locking pieces 35 of the ratchet guide 11, and since the tips of the locking pieces 35 are locked to the ratchet 10 by snap fit, the ratchet subassembly can be integrally assembled in advance. Since the subassembly can be fitted to the tubular shaft portion 6 of the rope reel 5 when being assembled into the starter case 2, assembling man-hours can be reduced.

Since the friction to the rotation of the ratchet guide 11 can be provided while preventing the coming off of the ratchet guide 11 only by locking and mounting the set spring 38 to the annular groove 37 of the end of the reel supporting shaft 3, the locking and mounting operation is significantly simplified as compared with operations, such as screwing, and assembly man-hours can be reduced without providing a dedicated friction imparting member.

Since positioning portions composed of the recesses and protrusions 16 and 20 are formed at facing surfaces of the starter case 2, and since the housing 1 and the starter case 2 is locked and fixed to the housing 1 by snap fit, the assembly operation of the starter case 2 is facilitated, and positioning and fixing can be realized by simple structure.

Next, how to use the above-described recoil starter will be described. When the recoil rope 7 is strongly pulled to rotate the rope reel 5, the inclined surfaces 28*a* of the annular wall 27 engage the ratchet arms 30 of the ratchet 10. Since the ratchet guide 11 cannot be rotated with respect to the starter case 2 by the frictional force of the set spring 38, the ratchet 10 moves in the axial direction from a standby position as the solid line of FIG. 1 to a position as the dotted line of FIG. 1 against the return spring 12 along the inclined surfaces 28*a*, and is locked to the locking surfaces 28*b*. By being moved to the shaft end side, the ratchet arms 30 abut against the locking surfaces 42*b* of the annular wall 40 of the driving pulley 13 located at the shaft end side. When the ratchet arms 30 abut against the locking surfaces 42*b*, since the ratchet 10 rotates along with the rope reel 5 by being pushed by the locking surfaces 28*b*, the rotation of the rope reel 5 is transmitted to the driving pulley 13 via the ratchet 10, thereby rotating the driving pulley 13 and starting the engine. When the engine starts, the rotation of the driving pulley 13 becomes faster than the rotation of the rope reel 5. Thus, the inclined surfaces 42*a* of the driving pulley 13 abut the ratchet arms 30 to push the ratchet 10 toward the standby position along the inclined surfaces 42*a*. Moreover, the ratchet 10 returns to the standby position by the spring force of the return spring 12. Then, when the pull-out of the recoil rope 7 is released, the rope reel 5 is reversed by the rewinding force of the spiral spring 4. Thus, the recoil rope 7 is rewound around the rope reel 5, and the start operation of the engine is completed.

What is claimed is:

1. A recoil starter comprising:

a starter case that is positioned to face an engine-side driving pulley and that has a reel supporting shaft at a center thereof;

a rope reel having:

a tubular shaft portion formed at a center of the rope reel to be rotatably engaged to the reel supporting shaft;

an engaging portion protruding from the rope reel to be substantially parallel to the tubular shaft portion;

a rope housing groove formed at an outer-peripheral side of the rope reel to house a recoil rope; and a spring housing portion formed at an inner-peripheral side of the rope reel to house a spiral spring for rewinding the rope reel;

a ratchet having:

a ratchet body axially-slidably arranged outside the tubular shaft portion; and a ratchet arm outwardly protruding from the ratchet body;

a ratchet guide attached to an end of the reel supporting shaft to provide a frictional resistance to a rotation of the ratchet; and a return spring provided between the ratchet guide and the ratchet to urge the ratchet toward a proximal end of the tubular shaft portion, wherein an inclined surface and a locking surface are formed on the engaging portion so as to be engageable with the ratchet arm, and wherein the inclined surface of the engaging portion is formed to guide the ratchet arm so that the ratchet is moved toward a distal end of the tubular shaft portion against the return spring and so that the ratchet arm engages with the driving pulley, thereby rotating the driving pulley and starting the engine, when the rope reel is rotated.

2. The recoil starter of claim 1, wherein the ratchet is formed such that a front side and a rear side thereof are symmetrical.

3. The recoil starter of claim 1, wherein an annular groove is formed on an outer periphery of a distal end of the reel supporting shaft, and wherein a potbelly-shaped set spring is locked and mounted to the annular groove so as to prevent the ratchet guide from coming-off therefrom and to provide a friction to a rotation of the ratchet guide with respect to the reel supporting shaft.

4. The recoil starter of claim 1, wherein the ratchet guide includes a plurality of locking pieces protruding therefrom to follow an outer shape of the tubular shaft portion, wherein the return spring and the ratchet are arranged outside the locking pieces, and wherein tips of the locking pieces are locked to the ratchet.

5. A recoil starter comprising:

a starter case disposed to face an engine-side driving pulley;

a reel supporting shaft formed at a center of the starter case; and a rope reel rotatably provided on the reel supporting shaft to transmit a rotation to the engine-side driving pulley and to start an engine when a recoil rope on the rope reel is pulled, wherein the rope reel includes:

a rope housing groove formed at an outer-peripheral side of rope reel to house the recoil rope; and a rope-end housing portion formed at an inner-peripheral side of the rope reel with respect to the rope housing groove, wherein a cutout is formed in a portion of a groove wall defining the rope housing groove to communicate the rope housing groove and the rope-end housing portion, and wherein a U-shaped guide groove is formed in the starter case to guide a pulling-out of the recoil rope.

6. A recoil starter comprising:

a starter case attached to an engine-side housing;

a reel supporting shaft formed at a center of the starter case; and a rope reel rotatably provided on the reel supporting shaft to transmit a rotation to an engine-side driving pulley and to start an engine when a recoil rope on the rope reel is pulled, wherein a pair of protrusion and recess are formed on facing surfaces of the starter case and the engine-side housing at corresponding positions, the pair of protrusion and recess positioning the starter case with respect to the engine-side housing, and wherein a pair of locking portions are formed on the starter case and on the engine-side housing at corresponding positions, the pair of locking portions engaging the starter case with respect to the engine-side housing by a snap fit.

* * * * *